US006802424B2

(12) United States Patent
Ouyoung

(10) Patent No.: US 6,802,424 B2
(45) Date of Patent: Oct. 12, 2004

(54) STRAINER IN SHOWER BATH TAP VALVE

(75) Inventor: Scott Ouyoung, Taichung Export Processing Zone (TW)

(73) Assignee: Globe Union Industrial Corp., Taichung (TW)

( * ) Notice: Subject to any disclaimer, the term of this patent is extended or adjusted under 35 U.S.C. 154(b) by 0 days.

(21) Appl. No.: 10/341,383

(22) Filed: Jan. 14, 2003

(65) Prior Publication Data

US 2004/0133975 A1 Jul. 15, 2004

(51) Int. Cl.[7] ..... B01D 35/02
(52) U.S. Cl. ..... 210/447; 137/550; 137/597; 137/606
(58) Field of Search ..... 4/256.1; 210/447; 137/550, 597, 606

(56) References Cited

U.S. PATENT DOCUMENTS 1,394,762 A * 10/1921 Schuermann ..... 210/447 X
1,817,376 A * 8/1931 Izquierdo ..... 4/292 X
4,949,406 A * 8/1990 Canelli ..... 4/256.1 X
5,525,215 A * 6/1996 Marchionda ..... 4/292 X

* cited by examiner

*Primary Examiner*—Robert M. Fetsuga
(74) *Attorney, Agent, or Firm*—Leong C. Lei

(57) ABSTRACT

An improved strainer in a shower bath tap valve is essentially having provided a trough respectively over the inlet passages of cold and hot water to place in a strainer comprised of support, seat and mesh; the strainer then is secured to the valve with fixation nuts so to make easier replacement of the strainer without removing couplings to both cold and hot water supply lines.

1 Claim, 5 Drawing Sheets

STRAINER IN SHOWER BATH TAP VALVE

BACKGROUND OF THE INVENTION (a) Field of the Invention

The present invention is related to an improved configuration for a strainer in a shower bath tap valve, and more particularly, to one that permits replacement of a strainer without having to remove the couplings of both cold and hot water lines.

(b) Description of the Prior Art

A shower bath tap described in the present invention relates to a fixed installation as illustrated in FIGS. 1 and 2 of the accompany drawings. Wherein, the valve 10 is built in a seat 1 installed in a pre-drilled opening in a wall. The seat 1 adapted with a handle 2 is exposed to allow control. The valve 10 inside the seat 1 is provided with cold and hot water inlets 11, 12 respectively connected to cold and hot water supply lines built in the wall. Both inlets 11, 12 are also connected to a water outlet 13 and a drain 14. The water outlet 13 is further connected to a diverter 3 respective to deliver the water to a showerhead 4 and a bathtub tap 5.

It requires a comparatively precise cartridge to regulate and control for a proper mixture of hot and cold water. To prevent foreign matters in the inlet water from compromising the performance of the cartridge and to warrant a clean delivery of water supply, a strainer must be each provided at the hot and cold water inlets. In the prior art as illustrated in FIG. 6, a strainer 20 is each directly provided at the openings of the cold and hot water inlets 11, 12 of the valve 10. However, both inlets 11, 12 must be respectively pivoted to a cold water supply line 6 and a hot water supply line 7. Therefore, upon replacing the strainer, couplings to both water supply lines 6, 7 must be first removed since that, as illustrated in FIG. 2, the valve is inserted in the wall where provides limited space to make it difficult to pivot the valve 10 to both water supply lines 6, 7.

SUMMARY OF THE INVENTION

The primary purpose of the present invention is to provide an improved configuration for a strainer in a shower bath tap valve that permits easy replacement of the strainer without having to remove the couplings to both hot and cold water supply lines. To achieve the purpose, the strainer is provided over the cold and hot water inlets.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
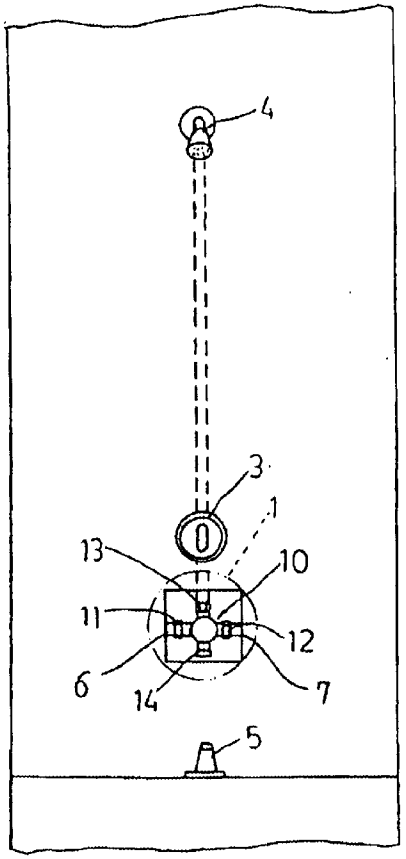
PRIOR ART FIG. 2
FIG. 2 is a front view of the shower bath tap valve.
Figure 1:
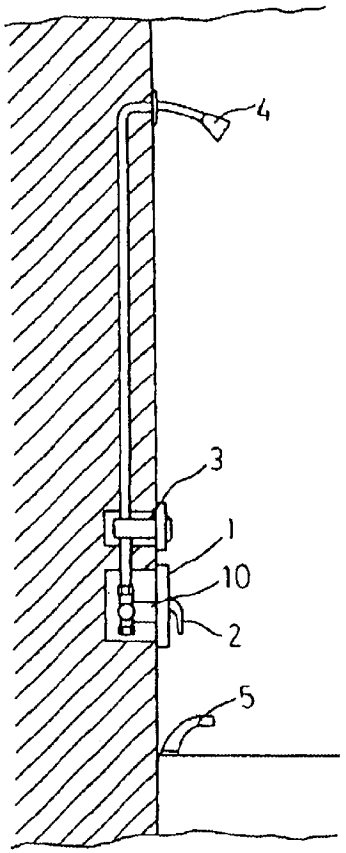
PRIOR ART FIG. 1
FIG. 1 is a side view of a shower bath tap valve.
Figure 3:
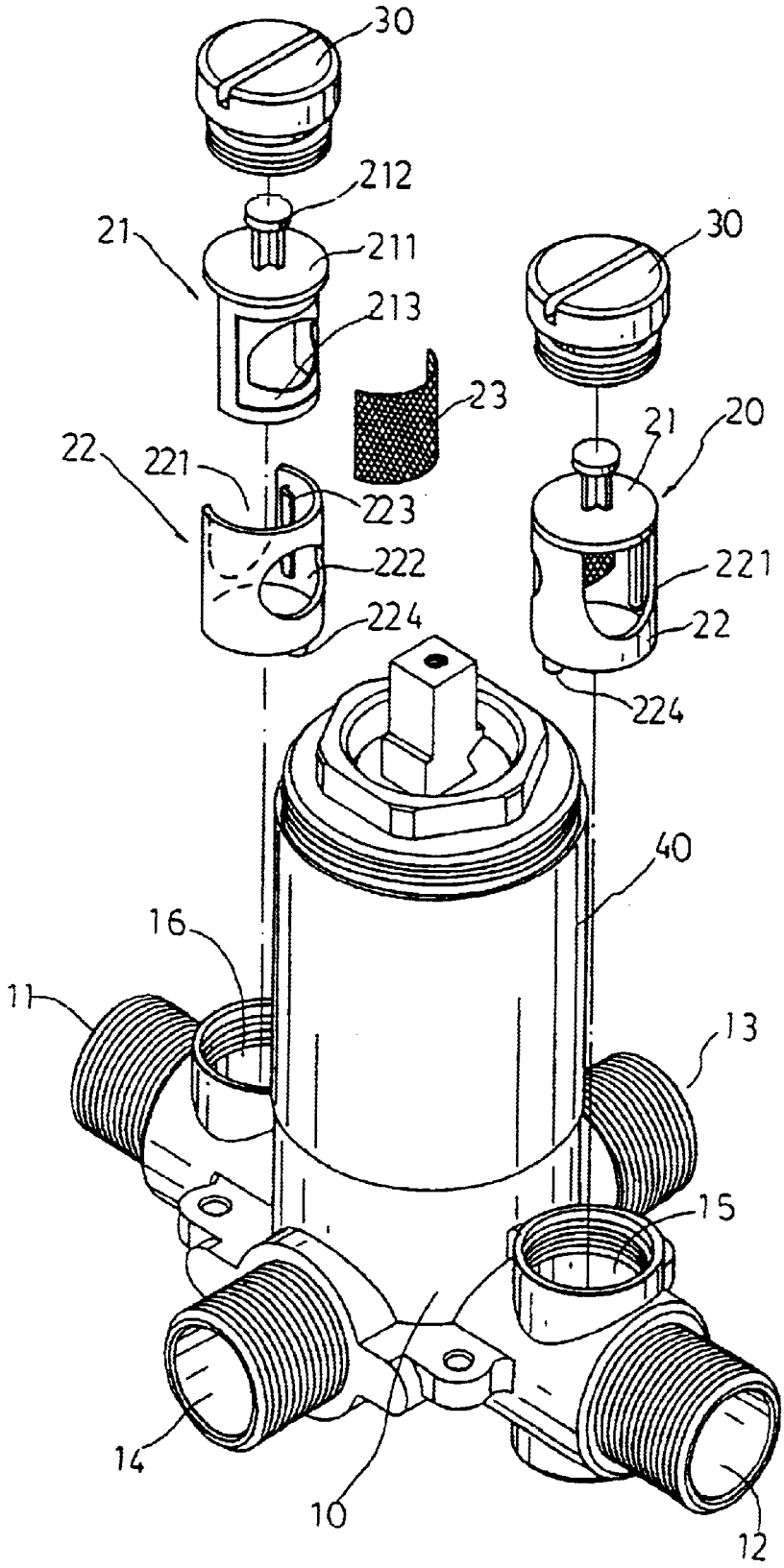
FIG. 3 is an exploded view of a preferred of the present invention.
Figure 4:
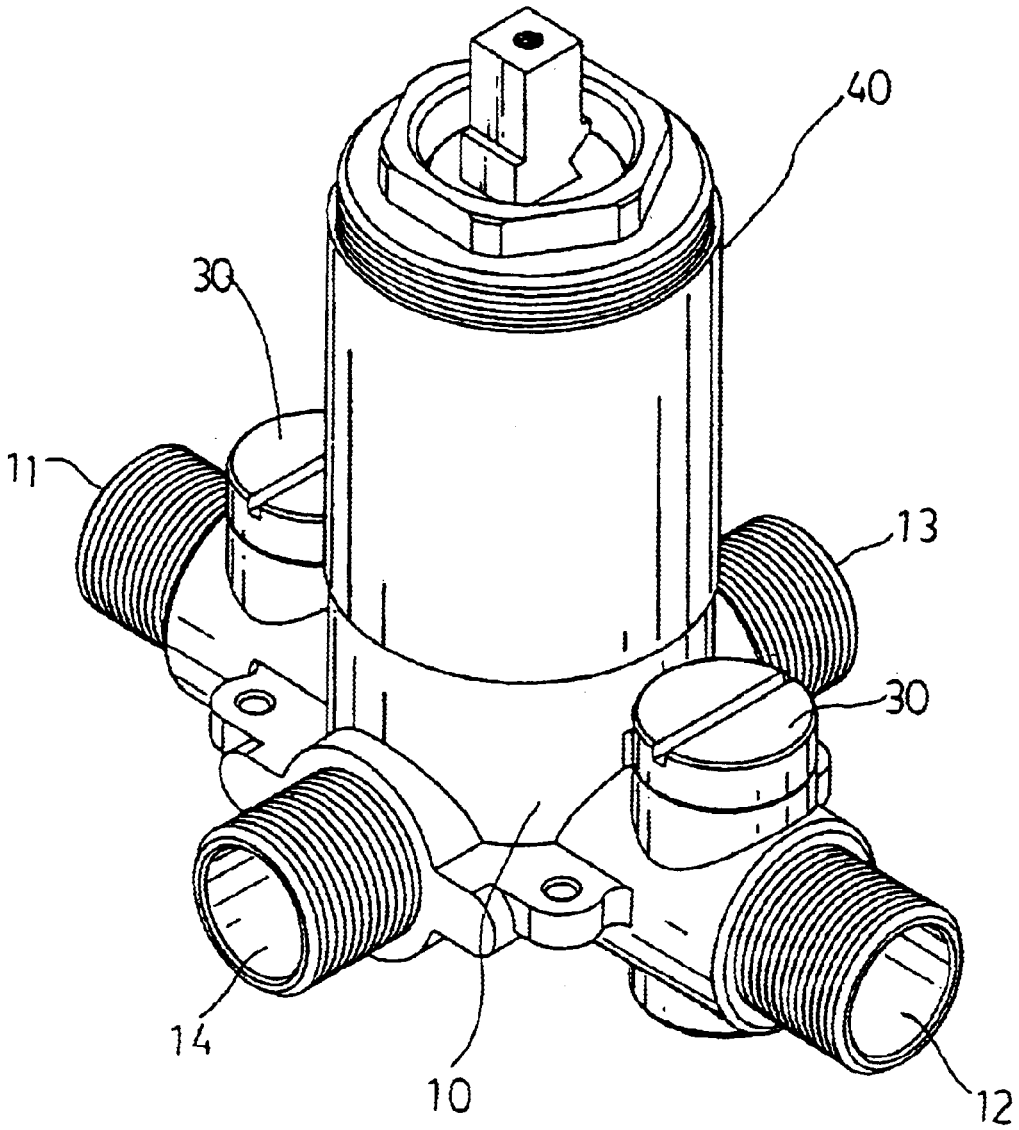
FIG. 4 is a schematic view of the preferred embodiment of the present invention as assembled.
Figure 5:
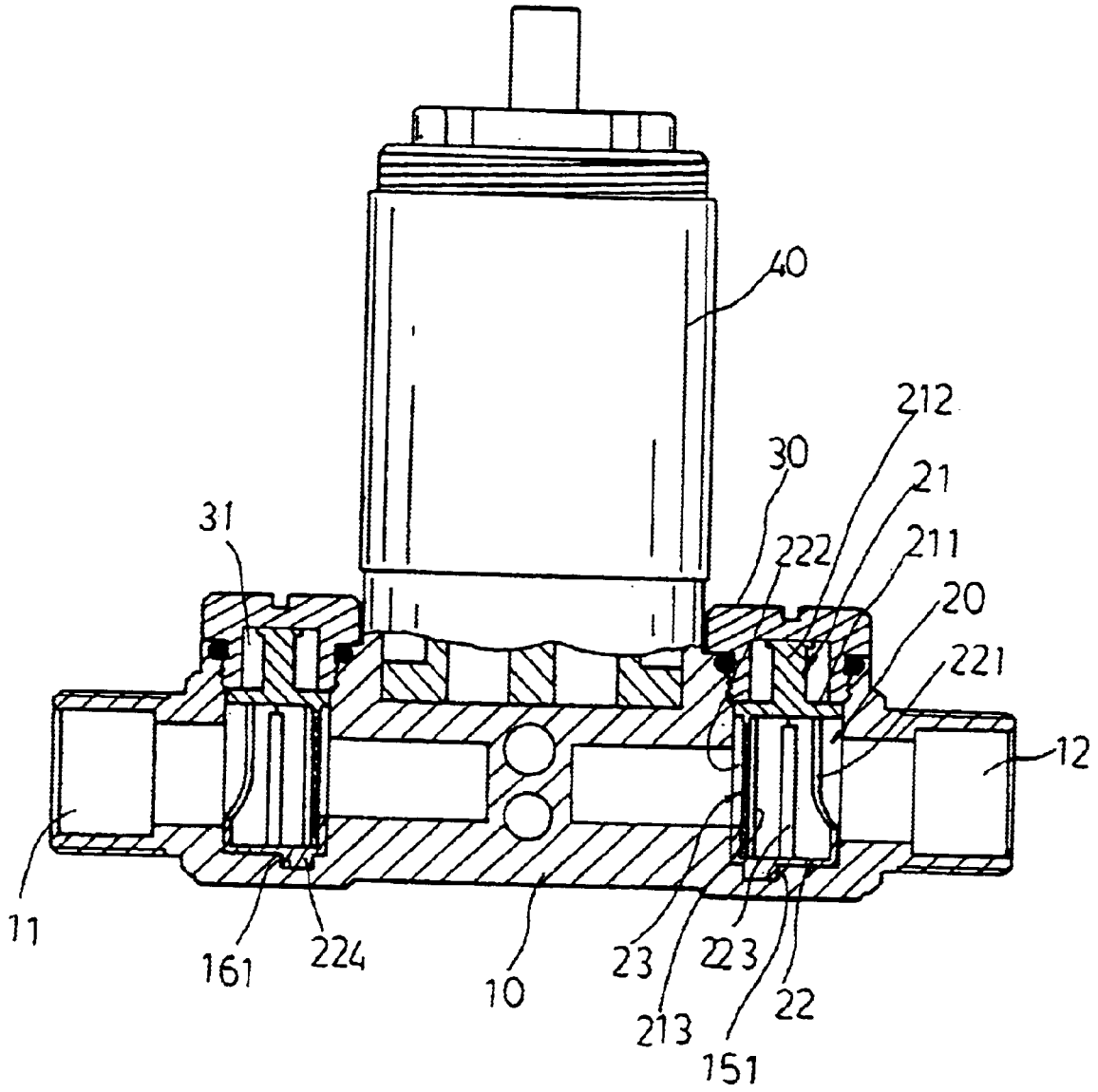
FIG. 5 is a sectional view of the preferred embodiment of the present invention.
Figure 6:
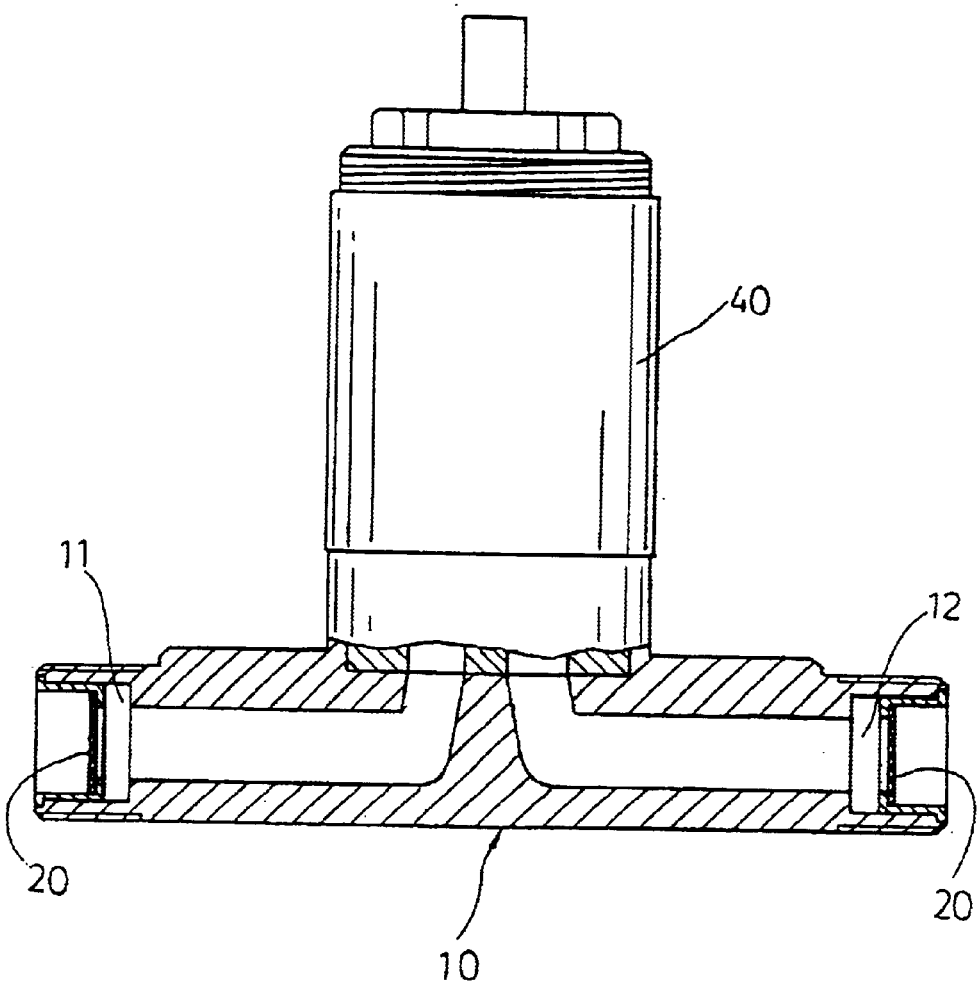
PRIOR ART FIG. 6
FIG. 6 is a sectional view of the prior art of the present invention.

Referring to FIGS. 3, 4 and 5, a valve 10 is provided with a cold water inlet 11, a hot water inlet 12, a water outlet 13, and a drain 14. A cartridge 40 is connected to the center at the top of the valve 10. Two strainer troughs 15, 16 are respectively opened at the top of the cold and hot water inlets 11, 12 for each to accommodate a strainer 20 before being blocked and secured with a fixation nut 30. Both strainer troughs 15, 16 are respectively connected through the cold and hot water inlets 11, 12 at a right angle; and the diameter each of both strainer troughs 15, 16 is greater than that of each of both two water inlets 11, 12. The strainer 20 includes a mesh support 21, a mesh seat 22, and a mesh 23. Wherein, the mesh support 21 in a diameter slightly smaller than that of a circular plate 211, which covers tip the strainer trough 15 (16). A rod 212 protrudes from the center of the top of the plate 211. An arc positioning frame 213 in radius smaller than that of the plate 211 is formed at the bottom of the mesh support 21 so to permit the mesh 23 to cover and rest on the outer arc surface of the positioning frame 213. The mesh seat 22 in inner radius equal to that of the positioning frame 213 relates to a cylindrical body having an open top. A gap 221 is cut on one side; and a through hole 222, on the other side of the mesh seat 22. A slit 223 in the direction of facing the through hole 222 is each provided on the mesh scat 22 at where close to the edge of both sides of the gap 221 so that both side frames of the mesh support 21 covered up with the mesh 23 merely to be inserted into the slit 223 and placed into the mesh seat with the mesh 23 covering up the through hole 222 to complete the assembly of the strainer 20. The strainer 20 is then placed into the strainer trough 15 (16) of the valve 10. As a certain direction is defined for the strainer 20 in the strainer trough 15 (16), a post 224 is downward provided at the bottom of the mesh seat 22 at where close to the through hole 222 and a circular recess 151 (161) is provided at the inner side of the strainer trough 15 (16) as illustrated in FIG. 5. Consequently, when the strainer 20 is placed into the strainer trough 15 (16), the post 224 is inserted into the circular recess 151 (161) for the gap 221 of the mesh seat 22 to face in the direction of the opening of the water inlet 11 (12). Furthermore, the rod 212 from the mesh support 212 of the strainer 20 inside the strainer trough 15 (16) is exposed Out of the opening of the strainer inlet 15 (16) to make it easy for removing the strainer 20. An accommodation trough 31 is formed at the bottom of the fixation nut 30 so that when the fixation nut 30 blocks the strainer trough 15 (16) and holes against the strainer 20, the rod 212 of the strainer 20 is received in the accommodation trough 31. With the configuration as described above, the strainer 20 can be easily removed for cleaning or replacing without having to remove the valve 10 and both water supply lines 6, 7.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved configuration for a strainer in a shower bath tap valve essentially having provided a strainer trough each over and connected through at a right angle with a cold and hot water inlet respectively; and a strainer comprised of a mesh support, a mesh seat, and a mesh being placed in the strainer trough and the strainer trough each being blocked with a fixation nut, wherein the mesh support having a circular plate provided on the top and an arc positioning frame at the bottom of the mesh support and a rod protruding from the center of the plate; the mesh seat having a cylindrical body with an open top, a gap cut on one side and a through hole provided on the other side, a slit being each provided in the plate on both sides close to the gap, and a post being provided on the bottom of the mesh seat; the mesh being mounted on the positioning frame of the mesh support and then placed in the mesh seat with both sides of the positioning frame of the mesh seat to lock into the slits to complete an assembly of the strainer.

* * * * *